United States Patent [19]

Neumann

[11] 4,445,548

[45] May 1, 1984

[54] FOOD PORTIONING MACHINE

[76] Inventor: Franz Neumann, 138 Dieppe Ave., Pointe Claire, Quebec, Canada, H9P 1X6

[21] Appl. No.: 342,201

[22] Filed: Jan. 25, 1982

[51] Int. Cl.[3] ..... B65B 1/04

[52] U.S. Cl. ..... 141/1; 141/153; 141/193; 141/248; 141/264; 141/387; 222/537; 285/188

[58] Field of Search ..... 141/250, 248, 263, 264, 141/266, 284, 367, 374, 387, 329, 1, 67, 71–73, 153, 178, 193, 251, 279; 285/188, 298, 302, 303, 31; 222/526, 537, 561; 239/587; 138/45, 46, 118, 120; 426/413, 414, 513, 515

[56] References Cited

U.S. PATENT DOCUMENTS

| | | | |
|---|---|---|---|
| 2,533,986 | 12/1950 | Atterbury | 141/263 |
| 3,166,025 | 1/1965 | Hulse | 141/263 |
| 3,373,777 | 3/1968 | Hawley | 141/263 |
| 3,738,464 | 6/1973 | Ortlip et al. | 141/284 |
| 3,811,483 | 5/1974 | Morrison | 141/264 |
| 4,017,940 | 4/1977 | Johnson et al. | 141/263 |

*Primary Examiner*—Stephen Marcus

*Assistant Examiner*—Kenneth S. Putnam

*Attorney, Agent, or Firm*—Larson and Taylor

[57] ABSTRACT

A portioning machine and a method for filling containers with food material is disclosed. The machine is particularly useful for meat products which are packed in plastic containers having a lip or edge, and prevents the food particles remaining on this lip and hence interfering with the sealing of the package. The machine has at least two filling stations and a pumping means to supply food material, each filling station is adapted to hold a container. The improvement comprises a filling tube connected to a slide portion in a slidable relationship with a stationary portion such that the filling tube may be positioned over either filling station, the slide portion having a slot which connects and overlaps with an aperture in the stationary portion, such that food material is pumped from pumping means through the stationary portion to the slide portion when the filling tube is positioned in either filling station, a telescopic nozzle at the end of the filling tube to extend downwards into a container in the filling station, and a combined knife and flap at the end of the nozzle to cut the food material and close the nozzle.

7 Claims, 10 Drawing Figures

FOOD PORTIONING MACHINE

The present invention relates generally to packing machines, and more specifically to a machine for portioning food material into containers.

Processed foods, particularly meat such as ham, poultry and beef, is today packaged in vacuum packed plastic containers, generally formed of high density polyethylene clear plastic sheet. Most of these containers when formed in a vacuum forming machine have a lip around their top edge to which a flat sheet is sealed after the container is filled. A problem that exists in this type of packaging is due to food particles remaining on this lip which interfere with the sealing of the package. In order to avoid this problem, it is generally necessary to have an operator clean each package after it has been filled with meat to remove any particles from the lip prior to sealing the flat sheet to the package.

The present invention provides a filling machine which portions processed food, particularly meat, into a package by ensuring that the nozzle through which the meat enters the package is inserted into the package and then is pushed up by the food as it fills the package. In this manner, no spillage of food occurs on the lip of the package. After commencement of the filling step, the machine fills one container with the required quantity of food material and then positions itself over another filling station, ready for the next filling step.

The portioning machine provides a filling tube which moves backwards and forwards between at least two filling stations, so that containers can be filled in each station, and has a telescopic nozzle which extends down into a container.

The present invention provides in a portioning machine for filling containers with food material, the machine having at least two filling stations and a pumping means to supply food material, each filling station adapted to hold a container, the improvement comprising, a filling tube connected to a slide portion in slidable relationship with a stationary portion such that the filling tube may be positioned over either filling station. The slide portion having a slot which connects and overlaps with an aperture in the stationary portion such that food material is pumped from the pumping means through the stationary portion to the slide portion when the filling tube is positioned over either filling station, a telescopic nozzle at the end of the filling tube to extend downwards into a container in the filling station, and a combined knife and flap at the end of the nozzle to cut the food material and close the nozzle.

In other embodiments the knife and flap are operated pneumatically. A limit switch may be incorporated to determine a rised position in the telescopic nozzle representing a full container. The limit switch is tripped when the food material pumped into the container raises the telescopic nozzle to the raised position to turn off the food material pumping means and close the combined knife and flap at the end of the nozzle. In another embodiment the slide portion is moved from one filling station to another by a pneumatic means with hydraulic damping means.

The present invention also provides a method for filling containers with food material in at least two filling stations, the improvement comprising the steps of, positioning a filling tube connected to a slide portion over a first filling station having a container therein, pumping food material through an aperture in a stationary portion, connected with a slot of the slide portion to extend a telescopic nozzle at the end of the filling tube downwards into the container. Opening in combined knife and flap at the end of the nozzle to permit food material to commence filling the container, continuing pumping food material through the nozzle so that as the container is filled, the telescopic nozzle is pushed upwards by the food material, closing the combined knife and flap when the telescopic nozzle reaches a predetermined height, raising the telescopic nozzle so the end of the nozzle is clear of the container, moving the slide portion to position the filling tube over a second filling station, and filling a container in the second filling station in the manner herein described.

In drawings which illustrate embodiments of the invention,

Figure 1:
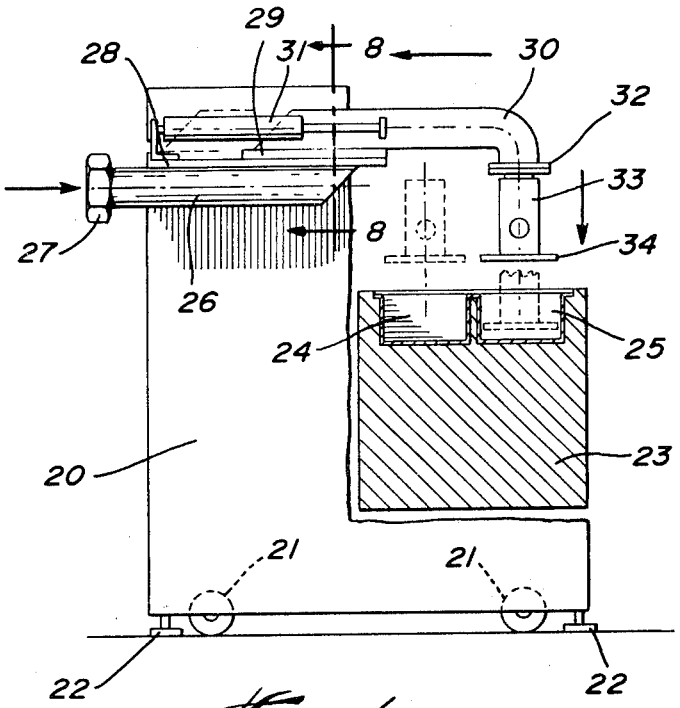
FIG. 1 is a side elevational view of one embodiment of the portioning machine according to the present invention.

One embodiment of a portioning machine according to the present invention is shown in FIG. 1 having a main support frame 20 mounted on wheels 21 and having retractable legs 22 so that the machine can be positively located in its operating position but can be moved for cleaning and maintenance. The frame 20 is L-shaped to allow for a separate packaging device 23 which has filling stations 24,25. The packing device 23 is preferably a vacuum packaging machine which forms a plastic container by pulling a vacuum underneath a sheet of plastic stretched over a form, and then holds the sheet in that shape during the filling stage. High density polyethylene plastic sheet is the preferred material for packaging food, however, neither the packing device 23 or the type of package form part of this invention. Preformed containers may be placed in the filling stations.

A fixed tubular portion 26 at the top of the frame 20 has a connecting flange nut to allow connection to a conventional stuffing machine. The type of stuffing machine can include a vane pump or a single or double piston stuffer. The stuffing machine itself does not form part of the present invention. The connecting flange nut 27 allows for quick and easy connection and disconnection between the stuffing machine and the portioning machine so it may be cleaned frequently. The material of the fixed tubular portion 26 is preferably stainless steel as is all the material in contact with food. All of the parts of the portioning machine that is contacted by food may be easily disassembled for cleaning purposes.

The fixed tubular portion 26 has a top plate 28 upon which rests a slide plate 29 attached to a filling tube 30. The filling tube 30 is moved by two pneumatic cylinders 31 so that the end 32 of the filling tube 30 is moved between the first filling station 24 and the second filling station 25. A telescopic nozzle section 33 is provided at the end 32 of the filling tube to allow the nozzle 34 at the end of the nozzle section 32 to extend downwards into the filling station 24 or 25. As illustrated in FIGS. 2 to 5 a combined knife and flap 35 is provided at the nozzle 34 to close the nozzle 34 during the operation of the machine.

Referring now to FIGS. 2-5, the operation of the portioning machine is illustrated. The top plate 28 of the fixed tubular portion 26 has an aperture 40 therein which connects and overlaps with a slot 41 in the slide plate 29 of the filling tube 30 so that when the slide plate 29 moves relative to the top plate 28 the filling tube 30 moves from one filling position to the other filling position, and the aperture between the slide plate 29 and the top plate 28 is still substantially the same size, and food material is pumped to the filling tube 30 without restriction.

Figure 2:
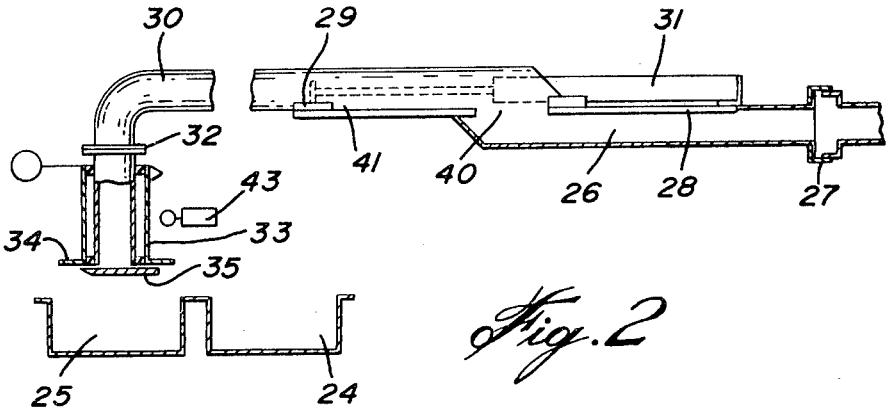
FIGS. 2–5 are schematic side views showing the operation of the portioning machine.
Figure 3:
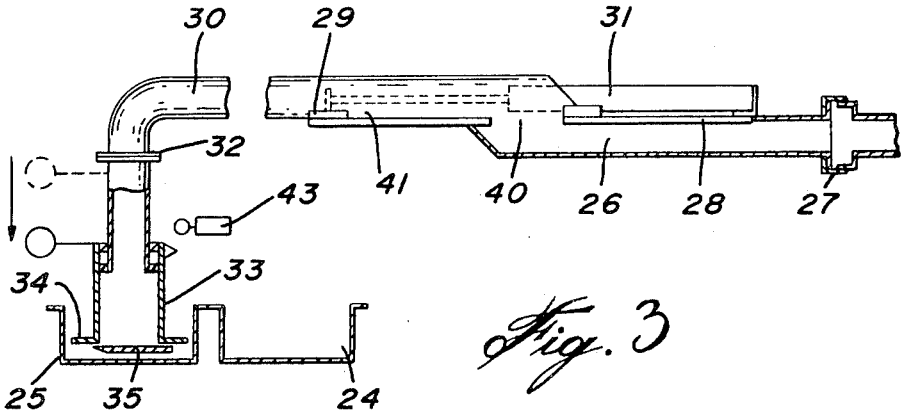
Figure 4:
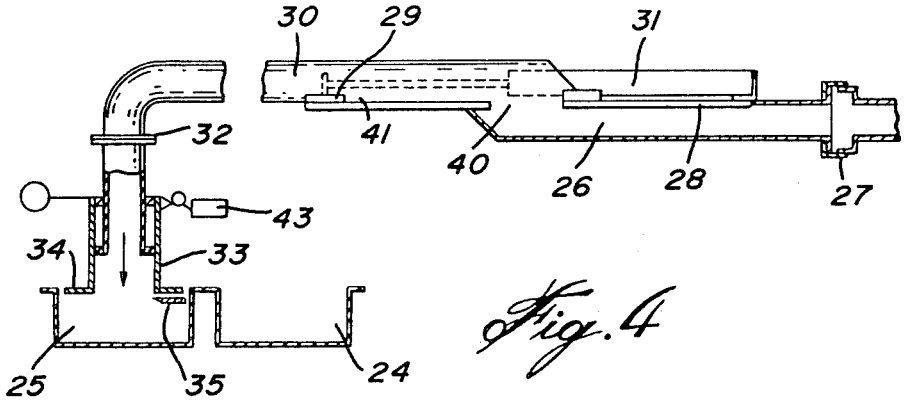
Figure 5:
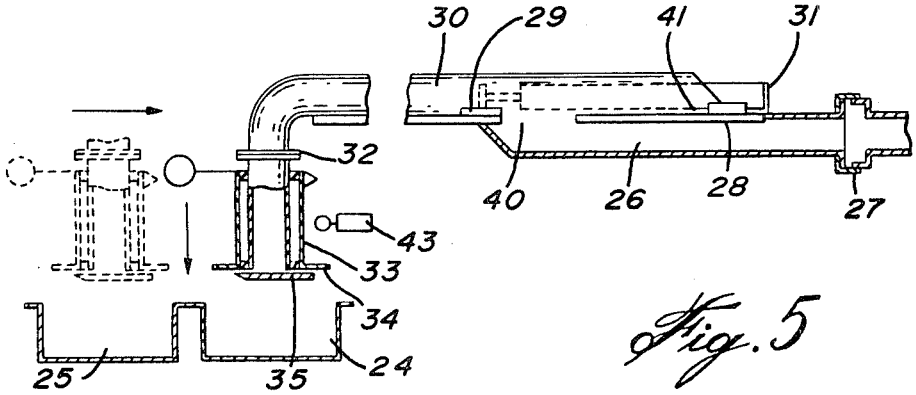

In operation the end 32 of the filling tube 30 is positioned over the filling station 25 as illustrated in FIG. 2. The telescopic nozzle section 33 is in the raised position and the combined knife and flap 35 at the nozzle 34 is closed. An operator activates the machine to commence the filling step. The stuffing machine commences to push food material through the fixed tubular portion 26, the aperture 40 and into the filling tube 30. The force of the food material moving along the pipe 30 pushes the telescopic nozzle section 33 downwards so that the nozzle 34 extends down into a container in the filling station 25. Thus, as shown in FIG. 3 the nozzle 34 is located almost at the bottom of the container and the combined knife and flap 35 then opens, allowing food material to flow into the container. As the container fills up, the nozzle 34 which has a flange surrounding it is pushed up by the food material until a limit switch 43 is triggered when the telescopic nozzle section 33 reaches a height which indicates that the container in the filling station 25 is full as shown in FIG. 4. The combined knife and flap 35 then closes and the telescopic nozzle section 33 is raised to its maximum height, as shown in FIG. 2, where it is completely clear of the container. The pneumatic cylinders 31 then activate to move the filling tube 30 so that the telescopic nozzle section 33 is positioned over the second filling station 24 as shown in FIG. 5 and the operator then activates the machine to commence filling the next container.

Each filling step is initiated by the operator and the machine then takes over, completes filling the container, and moves the filling tube 30 in position for the next filling step. Provided the density of the food material is substantially the same, and the containers are the same size, then the quantity of food material into each container is the same for each filling operation. Inasmuch as the food material does not fall from a height into the container, but is fed out through the nozzle 34 which is positioned in the container, food material does not splash or splatter on the lip of the container.

Figure 6:
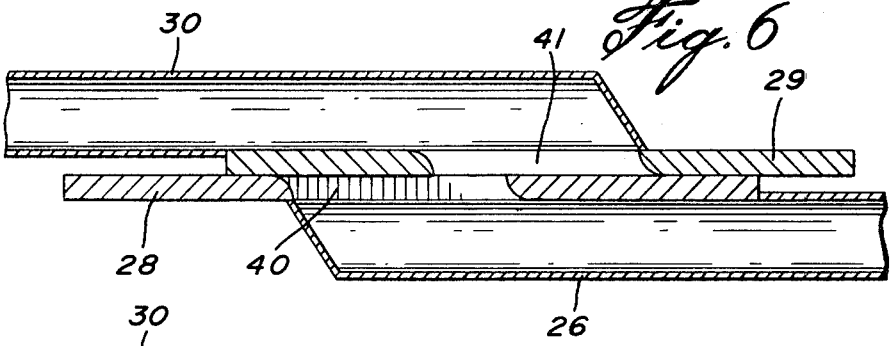
FIGS. 6 and 7 are cross sectional views of the slide and stationary portions positioned at two filling stations.
Figure 7:
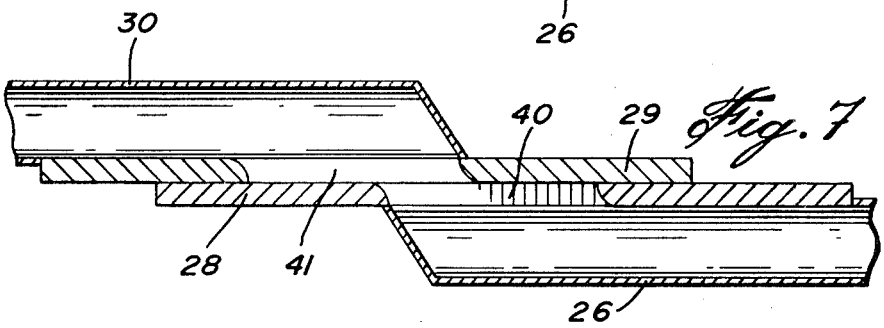
Figure 8:
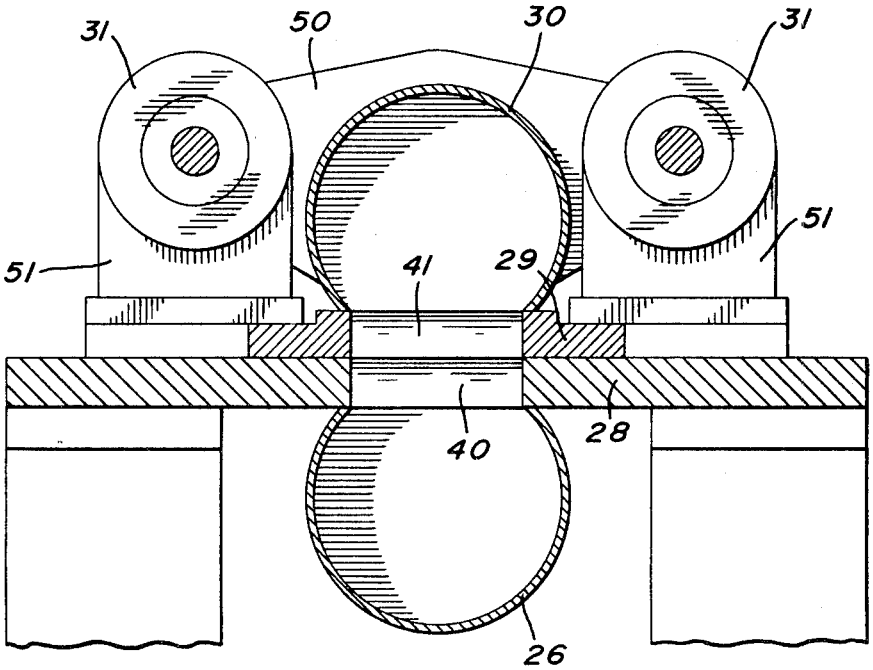
FIG. 8 is a cross sectional view at line 8—8 of FIG. 1.

FIGS. 6 to 8 illustrate the food material transfer arrangement between the filling tube 30 and the fixed tubular portion 26. The aperture 40 in the top plate 28 of the fixed tubular portion 26 is a slot which overlaps with the slot 41 in the slide plate 29 of the filling tube 30. The aperture slot 40 and the slot 41 are substantially the same width and length and are so arranged that the gap between the slide plate 29 and the top plate 28 is substantially the same when the filling tube 30 is in either of the two filling stations 24,25. The filling tube 30 is moved backwards and forwards by two pneumatic cylinders 31 as shown in FIG. 8 having a yoke 50 attached to the filling tube 30 with the cylinders 31 fixed to the top plate 28 of the filling tube 30 by brackets 51. In one embodiment hydraulic dampers are provided on the pneumatic cylinders 31 so that movement of the filling tube 30 from one filling station to the other is smooth and not jerky.

Figure 9:
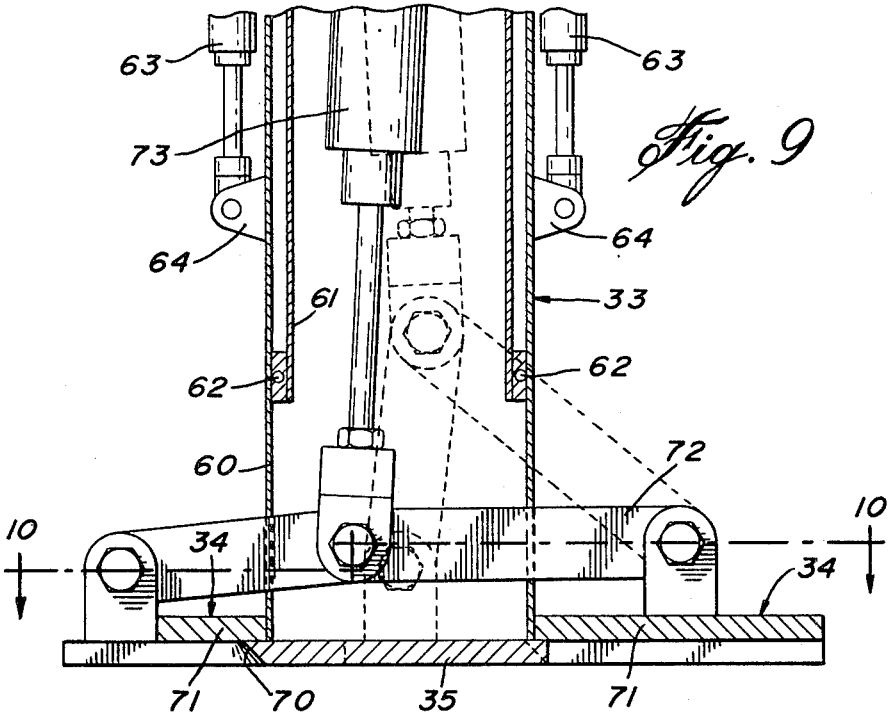
FIG. 9 is a partial cross sectional side view of the telescopic nozzle showing the combined knife and flap.
Figure 10:
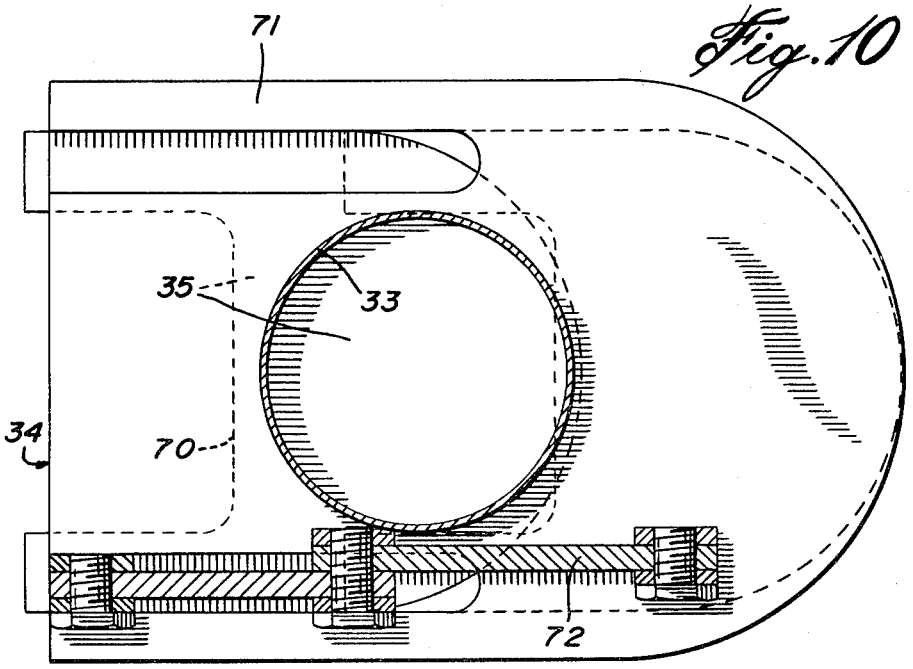
FIG. 10 is a cross sectional view at line 10—10 of FIG. 9.

The telescopic nozzle section 33 is fitted on the end 32 of the filling tube 30 together with the combined knife and flap 35 mounted on the nozzle 34 is illustrated in FIGS. 9 and 10. An outer tube 60 is in telescopic relationship with an inner tube 61 and has seals 62 at both top and bottom to prevent food particles being retained between the inner tube 61 and the outer tube 60. Pneumatic cylinders 63 connected to brackets 64 are attached to the outer tube 60 and move the outer tube 60 up and down relative to the inner tube 61. The inner tube 61 is secured to the end 32 of the filling tube 30 and has no vertical movement. The movement of the outer tube 60 downwards into a container is carried out by pressure from the food material being pumped through the filling tube 30 pushing against the closed combined knife and flap 35. The movement of the outer tube 60 upwards during the filling step is caused by the food material entering the container and pushing up against the lower surface of the flange forming the nozzle 34. The pneumatic cylinders 63 only complete the operation of returning the nozzle 34 to its fully raised position prior to filling.

The combined knife and flap 35 is shown in FIG. 10 to have a U-shaped configuration with a knife edge 70 to cut the food material when the combined knife and flap 35 closes. The knife edge 70 slides underneath the fixed plate 71 which represents the flange forming the nozzle 34 and is attached to the end of the outer tube 60. A linkage system 72 connected to a pneumatic cylinder 73 opens and closes the combined knife and flap 35. FIG. 9 illustrates the combined knife and flap 35 closed in full lines and open in chain-dotted lines In one example, a stuffing machine pushes ham through the portioning machine at a rate of 8 lbs/second. Thus a 1½ lbs container is filled in a fraction of a second, and provided the operator reacts quickly enough, containers may be filled every 4 seconds. In the case of a semi-automatic portioning machine, the operator commences each filling sequence. If the machine is automatic the time between filling containers is predetermined and may depend upon the forming of the containers or placing the containers into the filling stations. The filling stations have containers therein formed by vacuum packaging machines. Each container is a plastic package with a lip around the top edge, a flat film is then fitted over the plastic package, heat sealed to the lip, and then cut to the exact shape of the package. The meat is then cooked and the package labelled, at which time it is ready for shipping to food stores.

Whereas the combined knife and flap illustrated in the drawings slides, it has been found that a swing flap may be incorporated. A swinging flap takes up less space than a sliding flap and fits into a package 5"×3". In another embodiment, two handles are positioned on the telescopic nozzle section 33, which must be gripped by an operator as each handle has a push button thereon, both of which must be activated by the operator to commence the filling step. This ensures that the operator keeps both hands on the machine, thus ensuring safety for the operator and more hygenic packing.

Various changes may be made to the scope of the machine and process, as illustrated. The scope of the invention is limited by the following claims.

The embodiments of the invention in which an exclusive property of privilege is claimed are defined as follows:

1. In a portioning machine for filling containers with food material, the machine having at least two filling stations, and a pumping means to supply food material, each filling station adapted to hold a container, the improvement comprising, a supply conduit leading to a filling tube, said supply conduit being comprised of a sliding portion and a stationary portion, said sliding portion horizontally and externally overlapping said stationary portion to form a non-coaxial telescoping joint, said sliding portion having a slot which connects and overlaps with an aperture in the stationary portion, such that food material is pumped from pumping means through the stationary portion to the slide portion when the filling tube is positioned in either filling station, a telescopic nozzle at the end of the filling tube to extend downwards into a container in the filling station, and a combined knife and flap at the end of the nozzle to cut the food material and close the nozzle.

2. The machine according to claim 1 wherein the combined knife and flap are operated pneumatically.

3. The machine according to claim 1 or claim 2 including a limit switch to determine a raised position of the telescopic nozzle representing a full container, adapted to be tripped when the food material pumped into the container raises the telescopic nozzle to the raised position, to turn off the food material pumping means, and close the combined knife and flap.

4. The machine according to claim 1 wherein the slide portion is moved so that the filling tube is correspondingly moved from one filling station to another by pneumatic means with hydraulic damping means.

5. The machine according to claim 1 wherein the aperture in the stationary portion is a slot which overlaps with the slot in the slide portion to provide access of substantially the same cross section between the slide portion and the stationary portion at either filling station.

6. The machine according to any of claims 1,2 or 4 wherein the telescopic nozzle is forced upwards by the food material entering the container and is assisted by pneumatic means to raise the end of the nozzle clear of the container.

7. In a method for filling containers with food material in at least two filling stations, the improvement comprising the steps of, positioning a filling tube, connected to a supply conduit, horizontally over a first filling station, the filling station having a container therein, said supply conduit being comprised of a sliding portion and a stationary portion, said sliding portion horizontally and externally overlapping said stationary portion to form a non-coaxial telescoping joint, said sliding portion having a slot which connects and horizontally overlaps with an aperture in the stationary portion forming a flow passage pumping food material through said supply conduit and said filling tube to extend a telescopic nozzle at the ends of the filling tube downwards into the container, opening a combined knife and flap at the end of the nozzle to permit food material to commence filling the container, continuing pumping food material through the nozzle so that as the container is filled, the telescopic nozzle is pushed upwards by the food material, closing the combined knife and flap when the telescopic nozzle reaches a predetermined height, raising the telescopic nozzle so the end of the nozzle is clear of the container, moving the slide portion horizontally to position the filling tube over a second filling station in the manner herein described.

* * * * *